US008395097B2

(12) United States Patent
Bohlender et al.

(10) Patent No.: US 8,395,097 B2
(45) **Date of Patent: *Mar. 12, 2013**

(54) ELECTRICAL HEATING DEVICE

(75) Inventors: Franz Bohlender, Kandel (DE); Michael Niederer, Kapellen-Drusweiler (DE); Holger Reiss, Rheinzabern (DE)

(73) Assignee: Eberspacher catem GmbH & Co. KG, Herxheim (DE)

( * ) Notice: Subject to any disclaimer, the term of this patent is extended or adjusted under 35 U.S.C. 154(b) by 200 days.

This patent is subject to a terminal disclaimer.

(21) Appl. No.: 12/886,829

(22) Filed: Sep. 21, 2010

(65) Prior Publication Data

US 2011/0068099 A1 Mar. 24, 2011

(30) Foreign Application Priority Data

Sep. 22, 2009 (EP) ..... 09012039

(51) Int. Cl.
*H05B 3/10* (2006.01)
*F24H 1/10* (2006.01)

(52) U.S. Cl. ..... 219/548; 219/202; 219/481; 219/504; 219/505; 219/530; 219/532; 219/542; 219/538; 219/540; 392/485; 392/486; 392/491; 392/347

(58) Field of Classification Search ..... 219/202, 219/481, 548, 504, 530–2, 542, 538, 505, 219/540; 392/485–6, 491, 347
See application file for complete search history.

(56) References Cited

U.S. PATENT DOCUMENTS 6,055,360 A * 4/2000 Inoue et al. ..... 392/485
2003/0132222 A1 * 7/2003 Bohlender ..... 219/504

OTHER PUBLICATIONS

European Search Report Dated Jan. 25, 2010 for European Patent Application Serial No. EP 09 01 2039.
U.S. Appl. No. 12/886,814, Filed Sep. 21, 2010, entitled Electrical Heating Device.

* cited by examiner

*Primary Examiner* — Shawntina Fuqua
(74) *Attorney, Agent, or Firm* — Boyle Fredrickson, S.C.

(57) ABSTRACT

An electrical heating device, includes a housing in which at least one heat generating element with at least one PTC element and electrical strip conductors abutting oppositely situated lateral faces of the PTC element and a plurality of heat dissipating elements arranged in parallel layers are accommodated. The heat dissipating elements are held abutted on oppositely situated sides of the heat generating element, with the intermediate positioning of an electrical insulation. In order to be capable of improved high voltage operation, at least one conducting element electrically connects together a plurality of heat dissipating elements.

19 Claims, 6 Drawing Sheets

ELECTRICAL HEATING DEVICE

BACKGROUND OF THE INVENTION

1. Field of the Invention

This present invention relates to an electrical heating device, in particular for a motor vehicle, with a housing in which at least one heat generating element and a plurality of heat dissipating elements, which are configured in parallel layers, are arranged. In the housing a plurality of heat generating elements can be provided. Usually, for each heat generating element two heat dissipating elements are provided, which are mounted on oppositely situated sides of the heat generating element in order to discharge the heat produced by the heat generating element into the medium to be heated. Consequently, the heat dissipating elements are also designated as radiator elements, in particular when thermal dissipation into the air is desired.

The heat generating elements comprise at least one PTC element, on the opposite lateral faces of which electrical strip conductors are situated, through which the PTC element is supplied with current.

2. Description of the Related Art

Generic class-forming electrical heating devices are used in particular for heating air for the air conditioning of the vehicle passenger compartment and are being increasingly used to compensate the disadvantages associated with the reduced thermal dissipation of modern diesel engines, which include the fact that, particularly in the early operating phase of the engine, insufficient heat is available to heat the vehicle passenger compartment or to keep the windscreen free from condensation.

A generic electrical heating device is for example known from EP-A1-1 768 458. The electrical heating device described there has an increased electrical dielectric strength and is particularly suitable for high voltage operation. With this state of the art insulation in the form of an insulating layer is provided on the outer side of the strip conductors in each case so that the heat dissipating elements are situated, with the intermediate positioning of the insulating layer, on the associated heat generating element and are potential-free. An electrically conducting foreign body located on the electrical heating device and which, for example, touches the heat dissipating elements situated on opposite sides of the heat generating element, does not therefore lead to a short circuit.

SUMMARY OF THE INVENTION

The object of the present invention is to provide an electrical heating device of the type mentioned in the introduction, which can fulfil the practical requirements, in particular in an improved manner with high voltage operation.

This object is solved according to the present invention by an electrical heating device having the features of claim 1. This differs from the aforementioned generic class-forming state of the art due to a conducting element, which electrically connects together a plurality of heat dissipating elements.

This present invention provides the possibility of connecting a plurality of heat dissipating elements together electrically between which at least one heat generating element is included. This electrical connection normally occurs within the housing and through the conducting element which is held on the housing. The conducting element connects a plurality, preferably all the heat dissipating elements of the electrical heating device. The heat dissipating elements normally extend strictly parallel to the heat generating elements, which comprise the current-carrying strip conductors. Consequently, the heat dissipating elements, which are connected together electrically and are decoupled from the current-carrying conductors, act as a screen. This screen is electrically decoupled from the heat dissipating elements due to the electrical insulation provided between the heat generating and the heat dissipating elements. The screen is particularly effective when the heating block is surrounded on the outside by heat dissipating elements.

Normally, a layer structure of at least one heat generating element and the adjacent heat dissipating elements are taken to be a heating block. Depending on the heating power to be generated, a plurality of parallel layers of heat generating elements can form the heating block. To implement this invention the heating block is preferably held on the housing under the tension of a spring arranged in the housing. Normally, the housing is a housing of plastic which surrounds the heating block like a frame.

The screen is already very effective with just one conducting element which is provided on the face side of the heating block and which normally extends transversely to the layers of the heating block and is connected to the heat dissipating element. However, also two conducting elements can be provided on oppositely situated face sides of the heating block. The free ends of the layers of the layer structure are located on the face sides. It is assumed that the housing is a plastic housing with good electrically insulating properties.

Furthermore, the present invention focuses particularly on high voltage uses in which the electrical heating device is subjected to voltages of up to 500 V and/or outputs an electrical power significantly above the currently usual 2 kW, such as for example powers of between 3 and 6 kW, maximum up to 10 kW. Operational conditions of this nature for electrical heating devices are in particular conceivable in a modern electric vehicle, in particular when the electrical heating device is fed from the energy source which also supplies the electrical drive of the vehicle.

This present invention offers the possibility of providing the control components of a controller, which is provided in a constructional unit with the electrical heating device, with a screen which is electrically connected to the conducting element. Accordingly, not only the heating block, but also the control device is screened. Preferably, the conducting element or the screen for the control device can be connected to the ground potential of a vehicle, for example through a ground plug provided on the outer side of the housing.

The screen of the heating block or of the integrally provided control components is not insignificant with regard to EMC problems. With electrical heating devices of the generic type in a motor vehicle, normally high electrical powers are switched which can lead to electromagnetic interference within the motor vehicle. By connecting one, preferably a plurality, favourably all heat dissipating elements of the heating block to the ground potential of the motor vehicle these undesired effects can be reduced, even if not completely eliminated.

According to a preferred further development of the invention the conducting element is formed from a sheet metal strip. Preferably the conducting element is formed from the sheet metal strip by stamping and bending. Here, the conducting element can have guide and abutment surfaces for fixing the conducting element on the housing. Through the formation of a conducting element formed from a sheet metal strip, it can be economically manufactured and connected to the housing in a simple manner.

With regard to a reduction in weight, which is always desirable with vehicles, according to a preferred further development of the invention, it is suggested that the conducting element is formed with a conducting element base extending transversely to the layers of the heating block and with claws which protrude beyond the conducting element base and interact with the heat dissipating elements. These claws extend parallel to the layers of the heating block. With this preferred embodiment the conducting element is formed like a comb, in particular then when a plurality of heat dissipating elements are provided as part of the heating device. Here, the conducting element base is preferably used for the formation of functional surfaces and elements for fixing the conducting element on the housing. Optionally, guide surfaces, formed by stamping or bending processes, can be provided, which interact with mating surfaces formed on the plastic housing and facilitate the positioning of the conducting element during the installation of the electrical heating device.

The claws protruding from the conducting element base are optimally formed for the electrical contact with the heat dissipating elements. Each individual claw normally interacts with one heat dissipating element.

The heat dissipating elements are normally formed from thin sheet metal band, which is bent in a meandering manner in order to form a plurality of ribs extending essentially transversely to the layers of the heating block. The sheet metal material for forming the heat dissipating elements is normally a thermally well-conducting material, such as for example copper or aluminium. According to a preferred further development of the invention, the claws are formed such that on contacting the heat dissipating element they deform it plastically and abut against the element. A plastic deformation of this nature leads to an increase of the contact area between the claw and the assigned heat dissipating element. The plastic deformation normally occurs on closing the housing through a closing force causing the closure of the housing. The locating face for the conducting element here is preferably formed by the inner side of a transverse spar which delimits the air passage aperture through the housing. This normally has two oppositely situated passage apertures for the air to be heated, between which the heating block is exposed. It is assumed that the conducting element is supported on the inner side of a housing which also supports the layers of the layer structure in the direction of the medium flow through the electrical heating device. Oppositely situated locating faces for the heating block are provided which fix the heating block within the housing. Through these retaining surfaces a contact pressure is established through which the heat dissipating elements are located on the claws under plastic deformation.

According to a preferred further development of the present invention, which facilitates easy installation of the electrical heating device, the at least one conducting element forms a pre-assembled unit with the housing. In this pre-assembled unit the conducting element is fixed to the housing and held in a predetermined alignment. To achieve this, the conducting element comprises at least one latching element bent out of the plane of the sheet metal strip, with which the conducting element is joined to the housing.

Provided that only one conducting element is provided, which extends transversely to the layers of the heating block, it is preferably located on a control side of the housing where a control device is fixed on the housing. The conducting element is furthermore connected to a ground conductor which leads to the control device. The ground conductor facilitates the inclusion of the electrical value of the conducting element in the control of the electrical heating device. Thus, a ground monitor can be provided, which is preferably part of the control device and which compares the potential of the conducting element to the ground potential of the vehicle in order to detect any possible defect in the electrical insulation and preferably to completely stop operation of the electrical heating device in the case of a defect of this nature. With this control variant a risk to persons can be excluded who carry out installation and repair work in the region of the electrical heating device under the impression that the heat dissipating elements exposed within the air passage aperture are potential-free. This is because normally the electrically conducting parts of the heating block are accommodated in a so-called positional frame, the side edges of which are provided parallel to the layers of the heating block, but outside of the plane occupied by the heating block. Accordingly, the positional frames form edges which accommodate between them the conducting panel and normally also the insulation preferably in the form of a ceramic/plastic layer. These edges of the positional frames provided on both sides of the positional frame consequently cover the electrical strip conductors.

The integration of the heat dissipating elements into a control device furthermore offers the possibility of detecting fault currents within the electrical heating device. Here it is assumed that only the strip conductors with different polarity are supplied with current and the heat dissipating elements are connected to ground. If the control device in this respect finds deviations, it can output a fault signal. The corresponding examination can also occur based on an external control device which is operated by the manufacturer of the electrical heating device and before shipment of the latter detects any assembly faults by including the potential of the heat dissipating elements.

Further details of the present invention are given in the following description of an embodiment in conjunction with the drawing. The drawing shows the following:

DETAILED DESCRIPTION OF THE PREFERRED EMBODIMENTS

Figure 1:
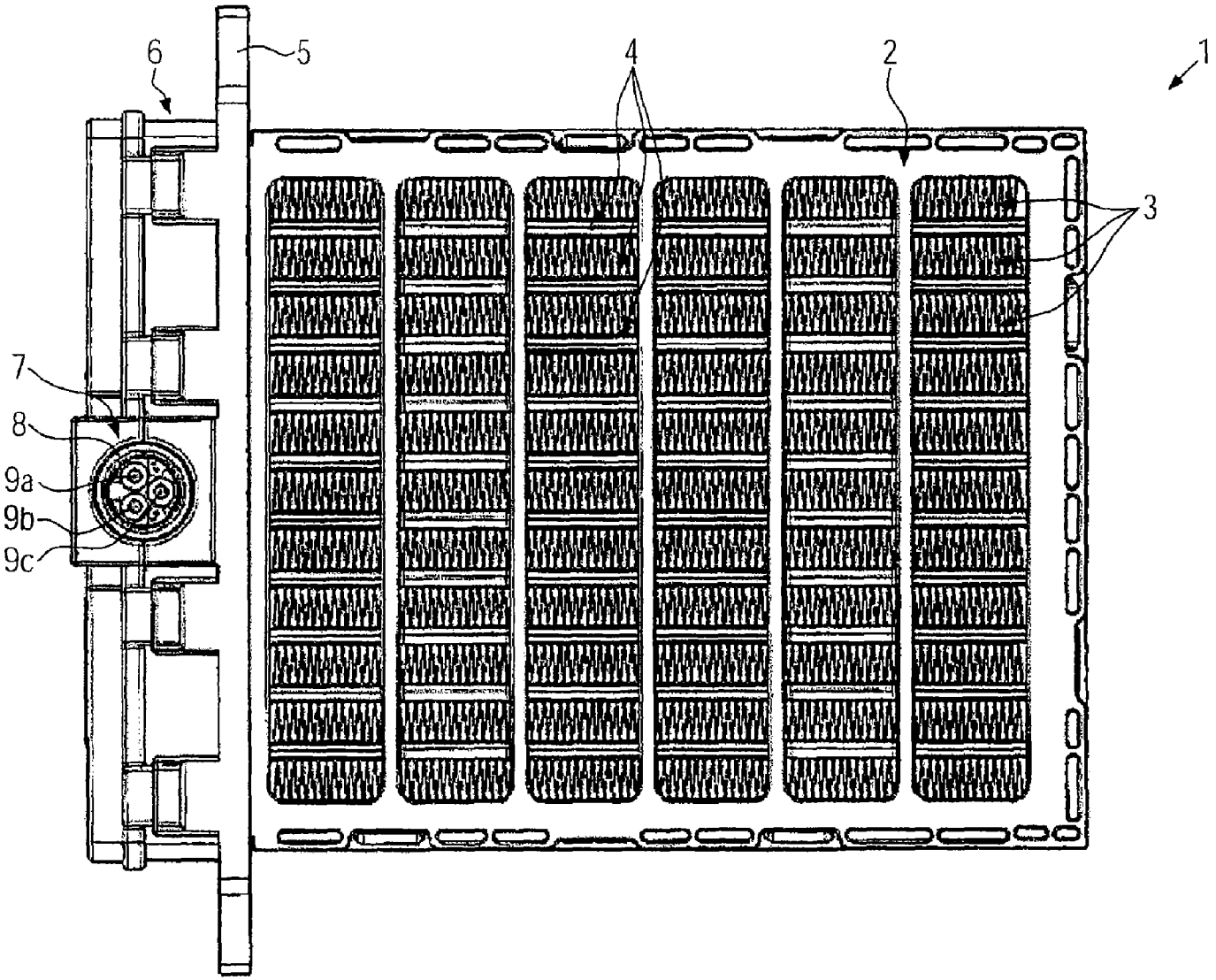
FIG. 1 a side view of an embodiment.

FIG. 1 illustrates a side view of an embodiment of an electrical heating device with a frame-shaped housing 1, which is formed from two plastic shells and accommodates a heating block 2. The heating block 2 comprises a plurality of heat dissipating elements 3 and a plurality of heat generating elements 4 which are provided in parallel layers. With the illustrated embodiment, at least on one longitudinal spar of the frame-shaped housing 1, a spring element (not illustrated) is provided, which holds the heating block 2 within the frame-shaped housing 1 under spring tension such that the layers of the layer structure are held pressed against one another. At the side of the heating block 2 the housing 1 has a mounting flange 5 as well as a control housing 6 protruding beyond the mounting flange 5. In this control housing 6 there is an electrical control device which is not further illustrated.

The embodiment illustrated in FIG. 1 can be electrically connected to the vehicle electrical system and the data network of the motor vehicle by control cables and power cables. In the illustrated embodiment a plug connection, identified with the reference numeral 7, is provided on the control housing 6 for the power cable and for the ground connection. The plug connection has attachment and guide surfaces in plastic, which are not shown in more detail, for a connecting mating connector on the end of a power cable. The power cable has a circumferentially formed screen, which is electrically connected to an annular ground connection 8 once the plug connection has been established. This annular ground connection 8 protrudes beyond the control housing 6 and surrounds the electrical connection elements 9*a* to 9*c* for the electrical connection of the power cables. The ground connection 8 is connected to the individual heat dissipating elements 3 using conductor tracks formed in the housing 1. The electrical connecting elements 9*a* to 9*c* are connected to individual or groups of heat generating elements 4 via power switches accommodated in the control housing 6 to supply them with current.

Figure 2:
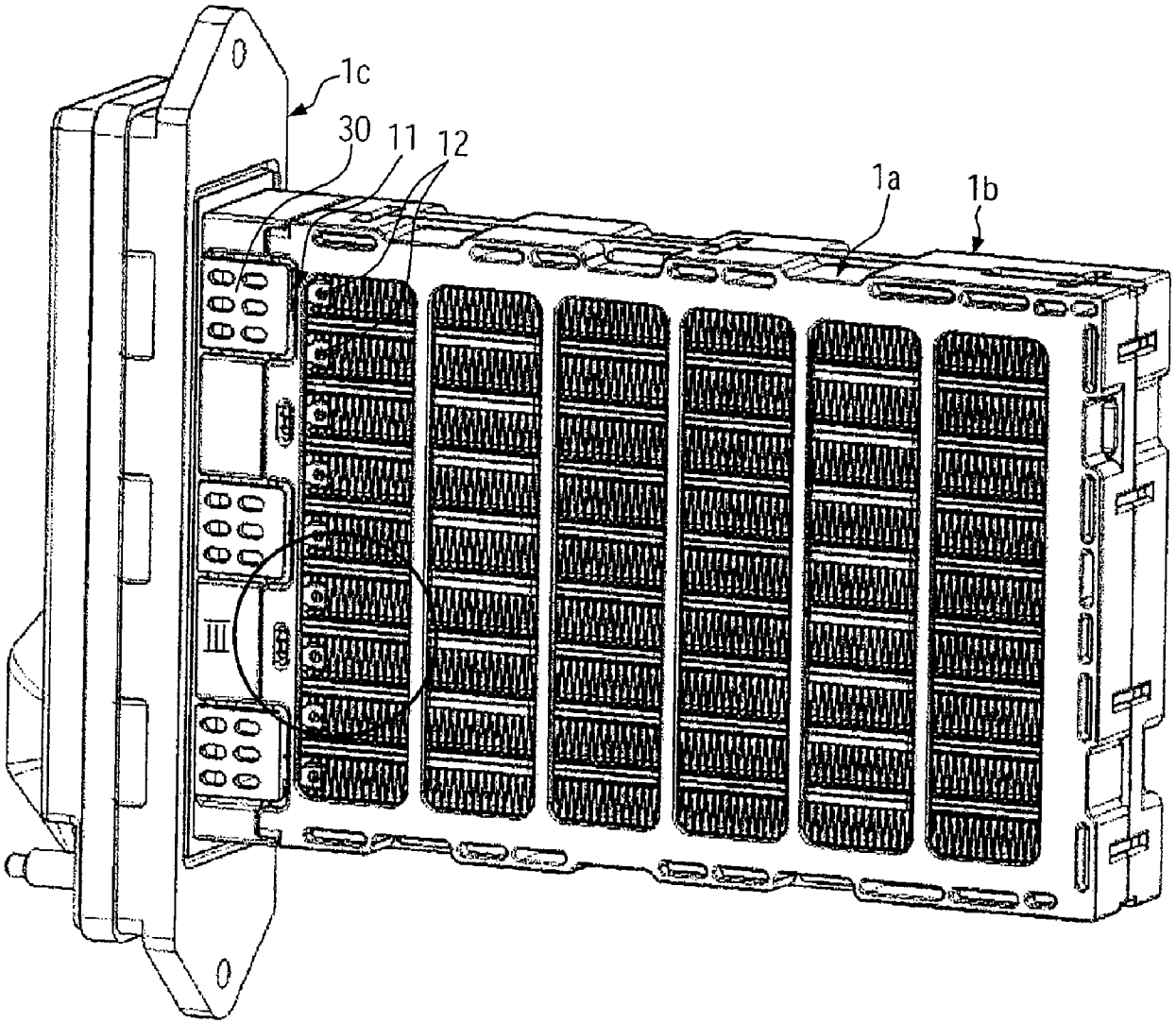
FIG. 2 a perspective side view of the opposite lateral face of the embodiment illustrated in FIG. 1.

The perspective side view according to FIG. 2 more clearly shows the structure of the housing 1. The housing 1 consists of two housing parts 1*a*, 1*b*, each of which is identically formed and protruded at the end by the control housing 6. In the control housing 6 a control device for the electrical heating device is provided, which comprises, among others, electronic control components for the control of the heating block 2. The heat dissipated by the control components is led away via the cooling elements identified with reference numeral 30 to the air flowing to the heating block 2. In this respect, at the side adjacent to the openings to the heating block, the housing 1 forms in each case three flow channels leading to the cooling elements 30. A transverse spar 11 of the housing provided adjacent to the cooling elements 30 is surmounted on the inside by a conducting element 10 with metal claws 12, which are located at about the height of the internal surface of the housing part 1*a* and interact with the heat dissipating elements 3 such that the claws 12 are in electrical contact with the meandering, bent sheet metal strips of the heat dissipating element 3. All the heat dissipating elements 3 interact with a corresponding claw 12, i.e. they are connected together electrically through the conducting element 10.

Figure 3:
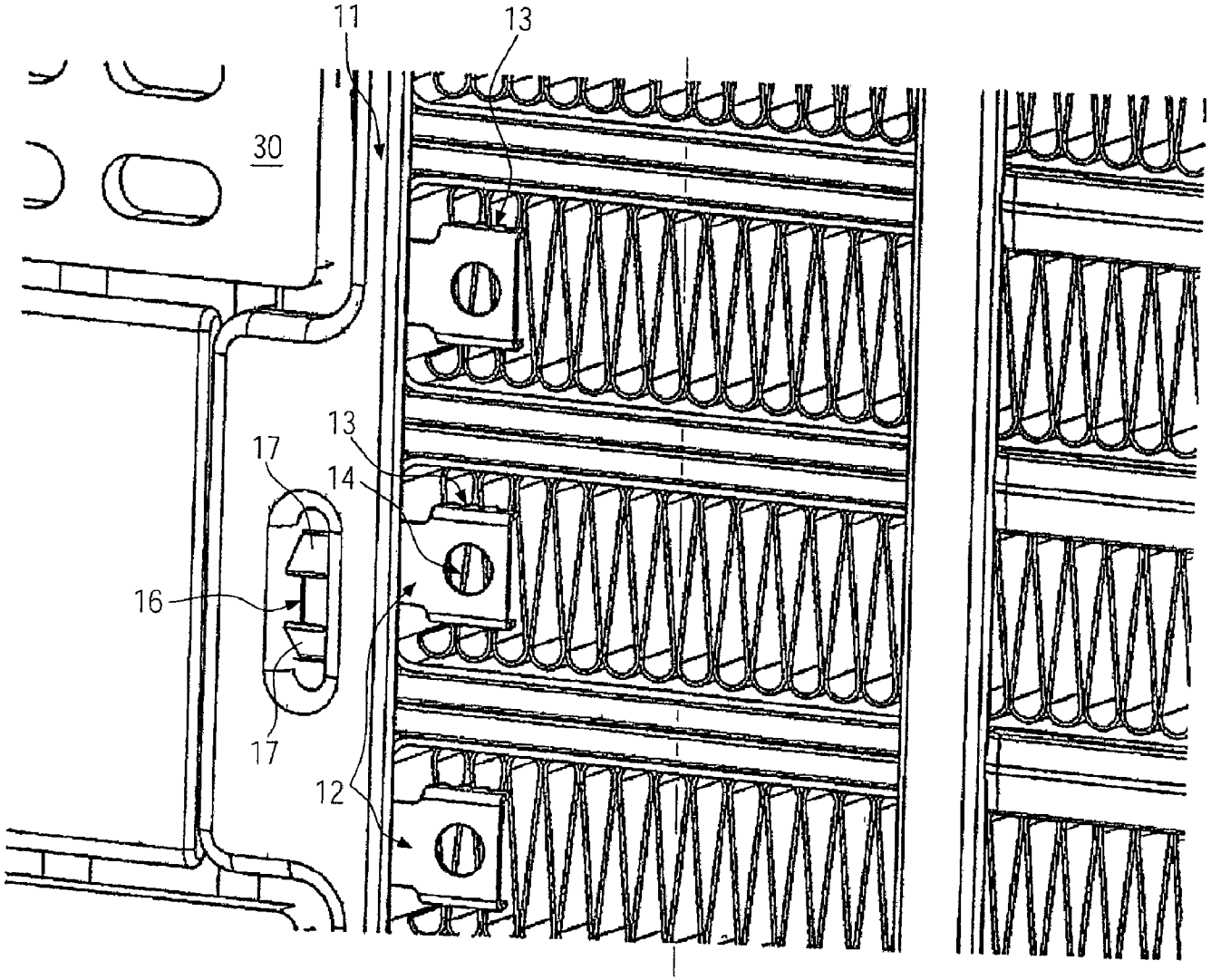
FIG. 3 the detail III drawn in FIG. 2 in an enlarged illustration.
Figure 4:
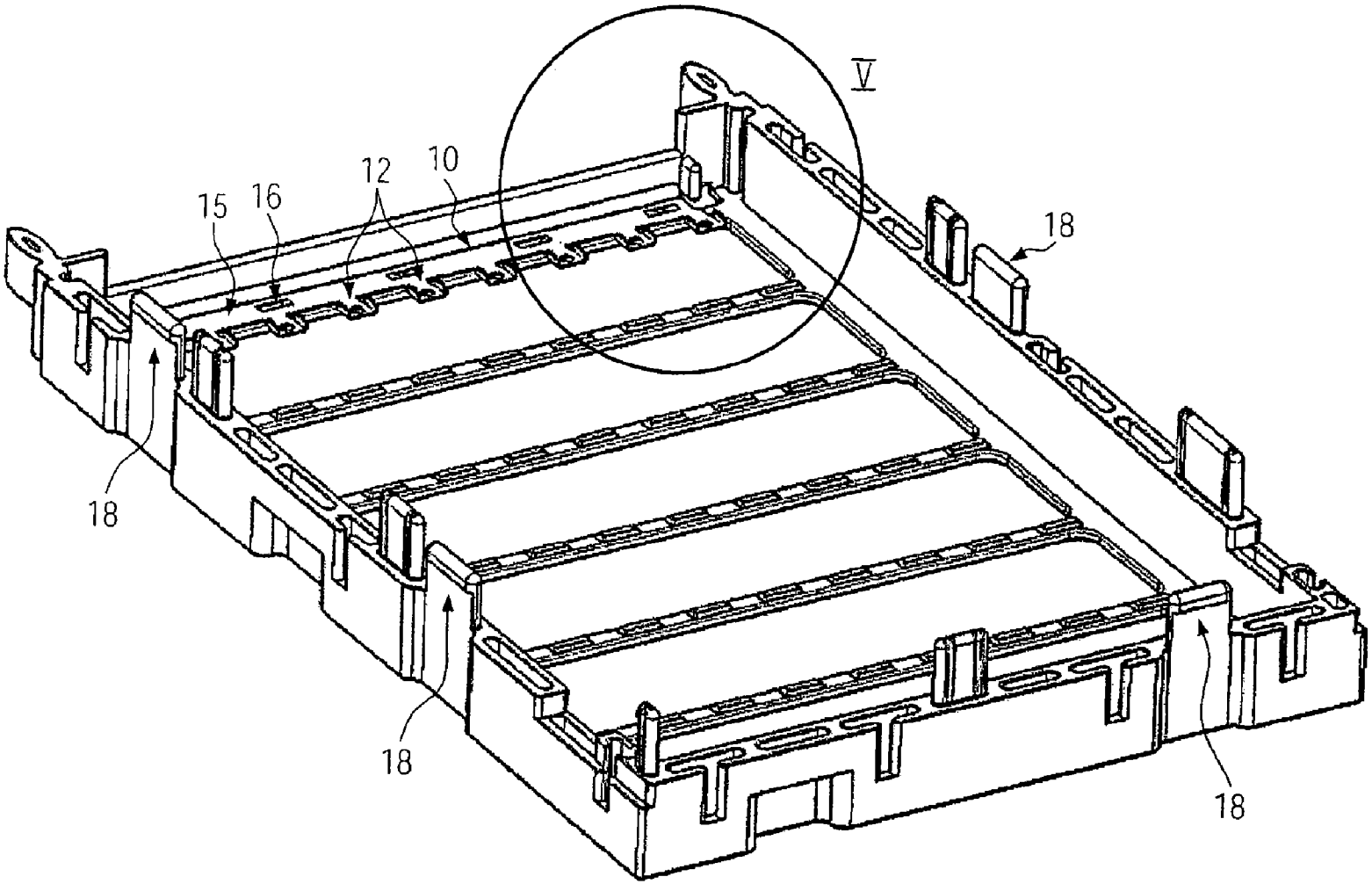
FIG. 4 the housing part illustrated in FIG. 2 before installation of the heating block.
Figure 5:
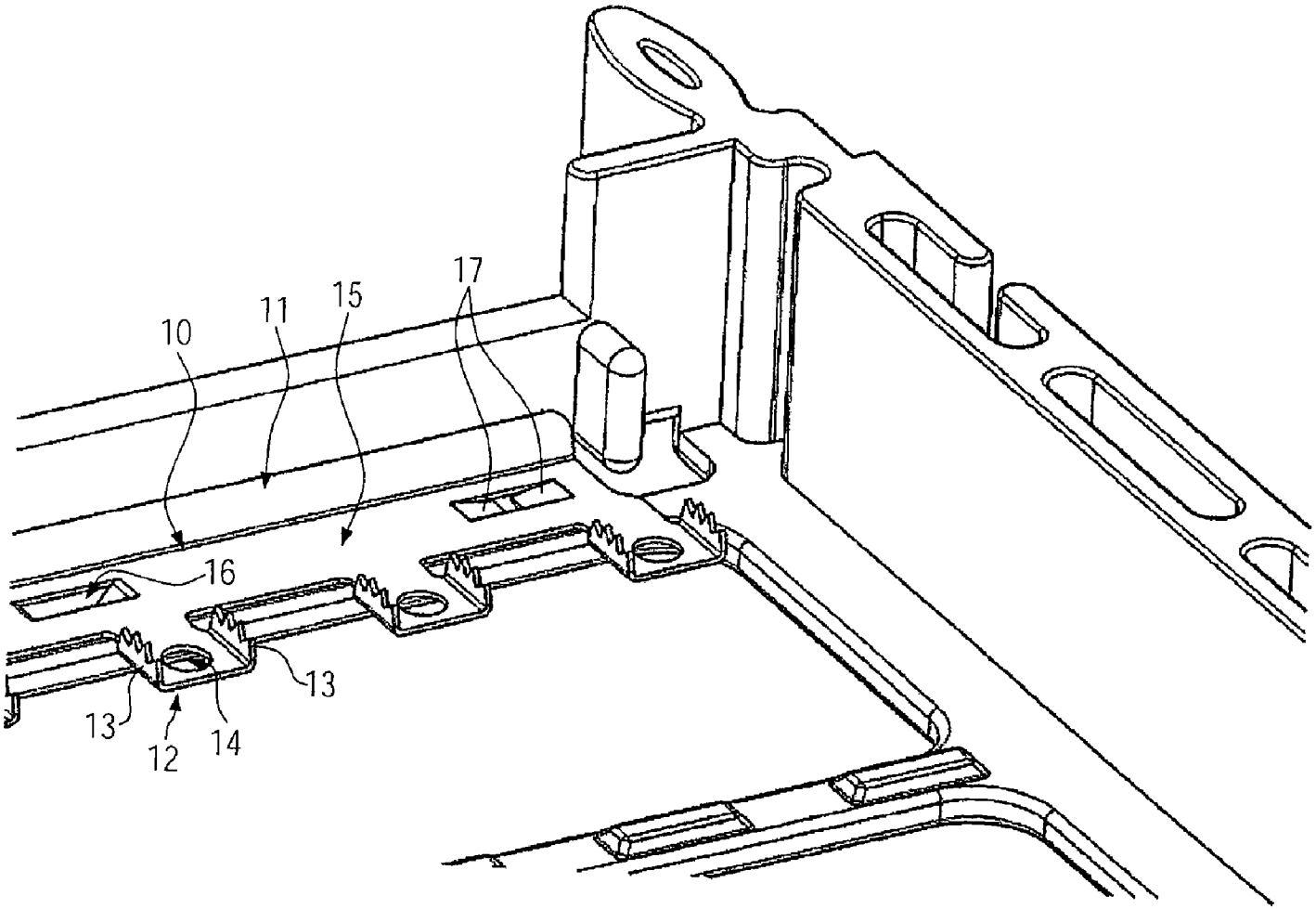
FIG. 5 the detail V illustrated in FIG. 4 in an enlarged illustration.

As can be seen in particular from FIG. 4, the claws 12 are formed by stamping from a sheet metal band. The claws 12 are cut free on the heating-block side of the longitudinal side of the sheet metal band by stamping and formed with rows of teeth 13 at the side by stamping and bending, as can be surmised in FIG. 3 and seen in FIG. 5. These rows of teeth 13 have a ridge, extending in the flow direction, i.e. at right angles to the layers of the heating block 2, from which a tooth profile protrudes, which interacts with the corrugated ribs of the heat dissipating element 3. To minimise the flow resistance by the claws 12 a recess 14 is provided centrally in the claws 12.

The claws 12 protrude from a longitudinal conducting element base 15, which extends parallel to the transverse spar 11 and abuts on its inner side. For mounting, latching receptacles 16 are cut out on the transverse spar 11. These latching receptacles 16 are located in each case between the cooling elements 30 (cf. FIG. 2). Spring-loaded latching lugs 17 are formed on the conducting element base 15 by stamping and bending. The conducting element base 15 can be mounted accordingly by clipping and interaction of the latching receptacles 16 with the latching lugs 17 on the housing part 1. The conducting element base 15 is normally electrically connected to parts of the control housing via a contact ridge, which for example can be formed by stamping and/or bending. Here, a ground monitor and/or a fault current measurement means is normally located, which is normally electrically connected to the conducting element base 15.

The heating block 2 is inserted into the unit, which can be seen in FIG. 4 and which is formed from an injection moulded plastic part 1*a* and the conducting element 10 formed from metal sheet, consisting of the conducting element base 15 and the claws 12. Here, in each case a heat dissipating element 3 is in each case attached to a claw 12. Furthermore, in the housing part 1*a* at least one spring is inserted, which subjects the heating block, respectively the layers forming the heating block 2 under tension, after final assembly of the electrical heating device, and in fact with a spring force, which is exerted transversely to the layers of the heating block 2 and within the plane of the heating block 2.

Once the elements of the heating block 2 and the at least one spring element have been installed in the housing part 1*a*, the housing 1 is closed. With this closure of the housing the latching tongues identified with reference numeral 18 and provided on the housing parts 1*a*, 1*b* spring into place so that both housing parts 1*a*, 1*b* are joined together. At the end of the joining movement in the direction of the air flow through the heating block 2, the claws 12 with their rows of teeth 13 are forced against the heat dissipating elements, which subsequently also partially deform plastically. At the end of the joining movement the claws 12 are reliably electrically connected to the heat dissipating elements 3.

Figure 6:
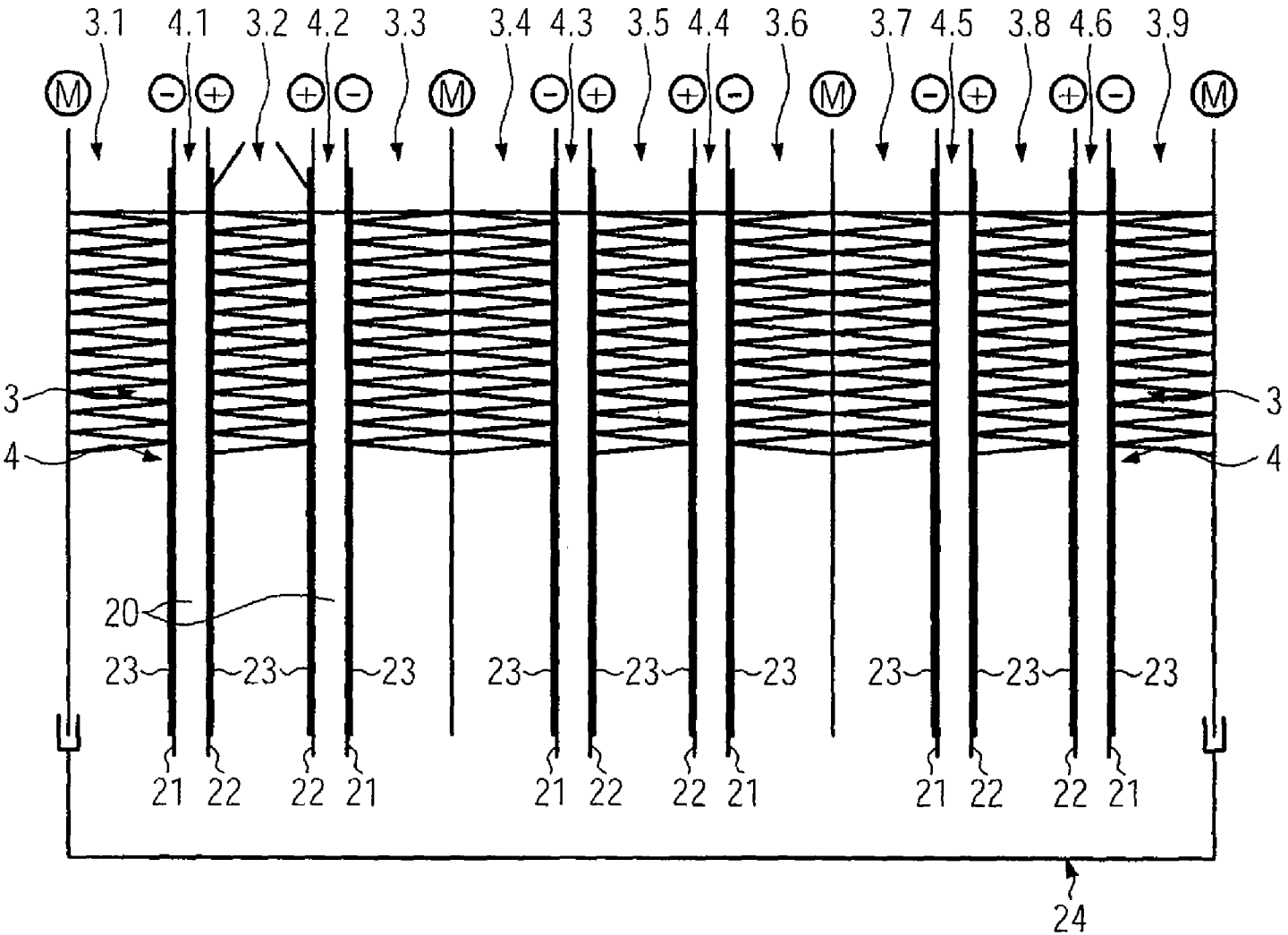
FIG. 6 a side view of a heating block of an embodiment for elucidating the electrical connection of the individual elements of the heating block for the purpose of this invention.

The electrical assignment of the individual elements of the heating block 2 to the connecting elements 8, 9 can be taken from the illustration in FIG. 6. It shows schematically a heating block with a plurality of heat generating elements 4, which are each provided with parallel alignment relative to one another and each at least comprising a PTC element 20 which is arranged between the strip conductors 21, 22 and is supplied with current via these strip conductors 21, 22. On the outer side of the strip conductor 21, 22 there are in each case electrically insulating layers 23.

The heat dissipating elements 3, formed as corrugated ribs, abut in each case on both sides of the heat generating elements 4. As can be see from FIG. 6, two heat generating elements 4.1, 4.2; 4.5, 4.6 each share a heat dissipating element 3.2, respectively 3.8. Just as easily, two identical heat dissipating elements 3.3, 3.4 are provided between two adjacent heat generating elements 4.2, 4.3.

In the embodiment elucidated in FIG. 6 all the heat generating elements 4 have in each case the insulating layer 23 on the outer side so that all heat dissipating elements 3 are provided potential free. The heat dissipating elements 3 are each electrically connected to the ground connection 8 via ground connections, which are formed with the claws 12 and identified with the reference numeral M in the electrical connection diagram according to FIG. 6. The corresponding situation applies to the strip conductors 21, 22 formed as sheet metal bands with reference to the electrical connecting elements 9*a* to 9*c* for the power current. The strip conductors 21 are each connected to the negative or ground pole and the strip conductors 22 are each connected to the positive pole of a power source. This connection often occurs however via intermediate switching of power switches, which are accommodated in the control housing 6 and can be switched via a logic circuit in the control housing. Furthermore, in the housing a ground monitor is provided which is not illustrated and which is electrically connected to all the ground connections M and preferably realises a potential balance between them and the ground connection 8 to determine any possible faults in an insulating layer 23, which would lead to a potential difference. However, the arrangement is selected according to FIG. 2 so that even with a fault in the insulating layer a short circuit still does not occur. Thus, the identical polarities of different and adjacent heat generating elements 4 are in each case situated opposite one another. Accordingly sheet metal bands of identical polarity are located on both sides of the heat dissipating elements 3.2, 3.3, 3.4, 3.5, 3.6, 3.7 or 3.8 arranged between two heat generating elements 4 and separate from the insulating layers 23.

In FIG. 6 a definitive embodiment of a screen of the heating block 2 is schematically illustrated, which is formed by a screen panel 24, which extends essentially at right angles to the layers of the heating block 2 and is connected to the free ends of the outer heat dissipating elements 3.1 or 3.9. An appropriate screen panel 14 can be provided such that the control elements of a control device are located within the screen. The screen can for example also be formed as part of a housing cover for the control housing 6 and only electrically connected to the outer heat dissipating elements 3.1 or 3.9 after closure of the control housing 6 by the housing cover.

List of Reference Numerals

Housing
1*a* Housing part
1*b* Housing part
2 Heating block
Heat dissipating element
Heat generating element
Mounting flange
Control housing
7 Plug connection
Ground connection
9*a* to 9*c* Connecting element
Conducting element
Transverse spar
12 Claw
Row of teeth
Recess
Conducting element base
Latching receptacles
17 Latching lug
Latching tongue
PTC element
Strip conductor
Strip conductor
23 Insulating layer
Screen panel
Cooling element
M Ground connection
−Negative pole of power current
+Positive pole of power current

The invention claimed is:

1. An electrical heating device, comprising:

a housing of plastic, in which are accommodated 1) at least one heat generating element with at least one PTC element and electrical strip conductors abutting oppositely situated lateral faces of the PTC element, and 2) a plurality of heat dissipating elements which are arranged in parallel layers and which are held abutted on oppositely situated sides of the heat generating element; an electrical insulation being displaced between the at least one heat generating element and the heat dissipating elements, wherein at least one conducting element electrically connects together a plurality of heat dissipating elements.

2. An electrical heating device according to claim 1, wherein the conducting element is formed from a sheet metal strip.

3. An electrical heating device according to claim 1, wherein the conducting element comprises a conducting element base extending transversely to the layers, and claws which protrude from the base and which interact with the heat dissipating elements and extend parallel to the layers.

4. An electrical heating device according to claim 3, wherein each of the claws contacts an assigned heat dissipating element in a plastically deforming manner.

5. An electrical heating device according to claim 1, wherein the conducting element forms a pre-assembled unit with the housing.

6. An electrical heating device according to claim 2, wherein the conducting element comprises at least a latching element which is bent out of a plane of the sheet metal strip and through which the conducting element is connected to the housing.

7. An electrical heating device according to claim 1, wherein a base of the conducting element contacts the inner side of a transverse spar of the housing delimiting an air passage aperture.

8. An electrical heating device according to claim 1, wherein the conducting element is provided on a control side of the housing on which a control device is fixed to the housing, and wherein the conducting element is connected to a ground conductor leading to the control device.

9. An electrical heating device according to claim 1, wherein the conducting element can be electrically connected to a ground potential.

10. An electrical heating device according to claim 9, wherein exposed electrical connecting elements for supplying current to the electrical strip conductors, and a ground connection are provided on the housing.

11. An electrical heating device according to claim 10, wherein the ground connection is provided in an annular shape around at least one electrical connecting element and can be connected to a screen of a connecting cable leading to the electrical connecting element.

12. An electrical heating device according to claim 1, wherein all of the heat dissipating elements are located with the intermediate positioning of an electrical insulating layer on the heat generating element and can be connected to a ground potential.

13. An electrical heating device comprising:

a plastic housing;

at least one heat generating element accommodated in the housing and including at least one PTC element and electrical strip conductors abutting oppositely situated lateral faces of the PTC element;

a plurality of heat dissipating elements accommodated in the housing and arranged in parallel layers, the heat dissipating elements being disposed oppositely situated sides of the heat generating element;

electrical insulation positioned intermediate the heat generating element and the heat dissipating elements; and at least one conducting element which electrically connects a plurality of heat dissipating elements together.

14. An electrical heating device, comprising:

a housing which is made of plastic, and in which are accommodated 1) at least one heat generating element with at least one PTC element and electrical strip conductors abutting oppositely situated lateral faces of the PTC element, and 2) a plurality of heat dissipating elements which are arranged in parallel layers and which are held abutted on oppositely situated sides of the heat generating element;

an electrical insulation which is displaced between the at least one heat generating element and the heat dissipating elements, wherein at least one conducting element electrically connects together a plurality of heat dissipating elements;

wherein the conducting element comprises a conducting element base extending transversely to the layers, and claws which protrude from the base and which interact with the heat dissipating elements and extend parallel to the layers.

15. An electrical heating device according to claim 14, wherein each of the claws contacts an assigned heat dissipating element in a plastically deforming manner.

16. An electrical heating device according to claim 14, wherein the conducting element forms a pre-assembled unit with the housing.

17. An electrical heating device according to claim 14, wherein the conducting element is formed from a sheet metal strip; and wherein the conducting element comprises at least a latching element which is bent out of a plane of the sheet metal strip and through which the conducting element is connected to the housing.

18. An electrical heating device according to claim 14, wherein the conducting element base contacts the inner side of a transverse spar of the housing delimiting an air passage aperture.

19. An electrical heating device according to claim 14, wherein all of the heat dissipating elements are located with the intermediate positioning of an electrical insulating layer on the heat generating element and can be connected to a ground potential.

* * * * *